US008143877B2

(12) United States Patent
Hwu et al.

(10) Patent No.: US 8,143,877 B2
(45) Date of Patent: Mar. 27, 2012

(54) SEMICONDUCTOR CIRCUITS CAPABLE OF MITIGATING UNWANTED EFFECTS CAUSED BY INPUT SIGNAL VARIATIONS

(75) Inventors: Sy-Chyuan Hwu, Taipei (TW); Chih-Chien Hung, Hualien (TW)

(73) Assignee: Mediatek Inc., Hsin-Chu (TW)

( * ) Notice: Subject to any disclaimer, the term of this patent is extended or adjusted under 35 U.S.C. 154(b) by 0 days.

(21) Appl. No.: 12/955,674

(22) Filed: Nov. 29, 2010

(65) Prior Publication Data

US 2011/0068764 A1 Mar. 24, 2011

Related U.S. Application Data

(62) Division of application No. 12/026,609, filed on Feb. 6, 2008.

(51) Int. Cl.
*G05F 3/16* (2006.01)

(52) U.S. Cl. ..... 323/313; 327/534

(58) Field of Classification Search ..... 323/312–317; 327/534–543

See application file for complete search history.

(56) References Cited

U.S. PATENT DOCUMENTS

| | | | | |
|---|---|---|---|---|
| 6,977,526 | B2 * | 12/2005 | Li | 326/83 |
| 7,375,559 | B1 * | 5/2008 | Cho et al. | 327/65 |
| 7,521,912 | B2 * | 4/2009 | Yamamoto et al. | 323/282 |
| 7,586,357 | B2 * | 9/2009 | Rentala et al. | 327/309 |
| 2007/0194838 | A1 * | 8/2007 | Mosinskis | 327/543 |

OTHER PUBLICATIONS

Rijns, J.J.F.; "CMOS Low-Distortion High-Frequency Variable-Gain Amplifier;" IEEE Journal of Solid-State Circuits; Jul. 1996; vol. 31; No. 7; pp. 1029-1034.

* cited by examiner

*Primary Examiner* — Jessica Han
(74) *Attorney, Agent, or Firm* — Thomas|Kayden

(57) ABSTRACT

Semiconductor circuit capable of mitigating unwanted effects caused by variations in a received input signal are provided, in which a main circuit receives an input signal and comprises a first current source coupled between a first node and a first power voltage to generate a first current according to a first bias voltage. A replica circuit is coupled to the main circuit to duplicate a variation in a voltage at the first node caused by a variation in the input signal and dynamically adjusts the first bias voltage according to the duplicated variation such that the first current is maintained at a constant.

9 Claims, 8 Drawing Sheets

SEMICONDUCTOR CIRCUITS CAPABLE OF MITIGATING UNWANTED EFFECTS CAUSED BY INPUT SIGNAL VARIATIONS

CROSS REFERENCE TO RELATED APPLICATIONS

This application is a Divisional of application Ser. No. 12/026,609, filed Feb. 6, 2008, the entirety of which is incorporated by reference herein.

BACKGROUND OF THE INVENTION

1. Field of the Invention

The invention relates to semiconductor circuits, and in particular to a semiconductor circuit capable of mitigating unwanted effects caused by variations in a received input signal.

2. Description of the Related Art

For most analog circuits, "current source" is one of the most fundamental elements determining overall circuit performance. Therefore, a current source with large output resistance is always required in analog circuits. In CMOS circuits, a simple current source is configured as shown in FIG. 1. The source and gate of the NMOS transistor MA are tied to constant voltages respectively, and the drain is the output node of the current source. Such simple circuitry usually cannot provide enough output resistance, thus, additional NMOS transistor MB can be cascaded with the current source (i.e., MA) to enhance the output resistance by clamping the voltage of the NMOS transistor MA, as shown in FIG. 2. Further, a so-called "gain-boosting" circuit can also be applied to the current source, as shown in FIG. 3.

However, the above schemes consume voltage head room, thus, making them unsuitable for low voltage requirements of advanced CMOS processing technology.

BRIEF SUMMARY OF THE INVENTION

Embodiments of a semiconductor circuit are provided, in which a main circuit receives an input signal and comprises a first current source coupled between a first node and a first power voltage to generate a first current according to a first bias voltage. A replica circuit is coupled to the main circuit to duplicate a variation in a voltage at the first node caused by a variation in the input signal and dynamically adjusts the first bias voltage according to the duplicated variation such that the first current is maintained at a constant.

The invention provides another embodiment of a semiconductor circuit, in which a main circuit receives an input signal and comprises a first current source coupled between a first node and a first power voltage to generate a first current according to a first bias voltage. A replica circuit is coupled to the main circuit to duplicate a distortion current through the first current source caused by a variation in the input signal and outputs the duplicated distortion current to the main circuit such that the output current of the main circuit is maintained at a constant.

The invention provides an embodiment of a method for mitigating current variation in a semiconductor circuit, in which the semiconductor circuit comprises a main circuit receiving an input signal and comprising a first current source coupled between a first node and a first power voltage. In the method, a voltage variation at the first node caused by a variation in the input signal is duplicated to dynamically adjust a bias voltage of the first current source such that a first current provided by the first current source is maintained at a constant.

The invention provides another embodiment of a method for mitigating current variation in a semiconductor circuit, in which the semiconductor circuit comprises a main circuit receiving an input signal and comprising a first current source coupled between a first node and a first power voltage. In the method, a distortion current through the first current source caused by a variation in the input signal is duplicated and is then output to the main circuit such that the output current of the main circuit can be maintained at a constant.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
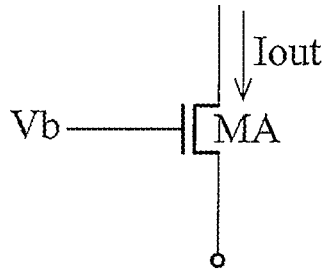
FIG. 1 ( PRIOR ART )
FIG. 1 shows a conventional current source.
Figure 2:
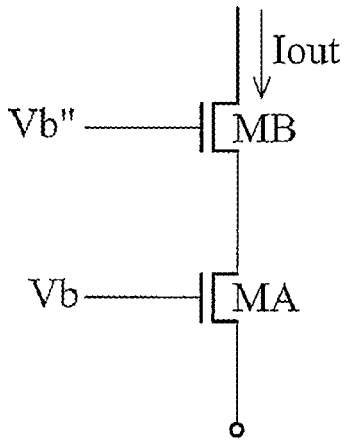
FIG. 2 ( PRIOR ART )
FIG. 2 shows another conventional current source.
Figure 3:
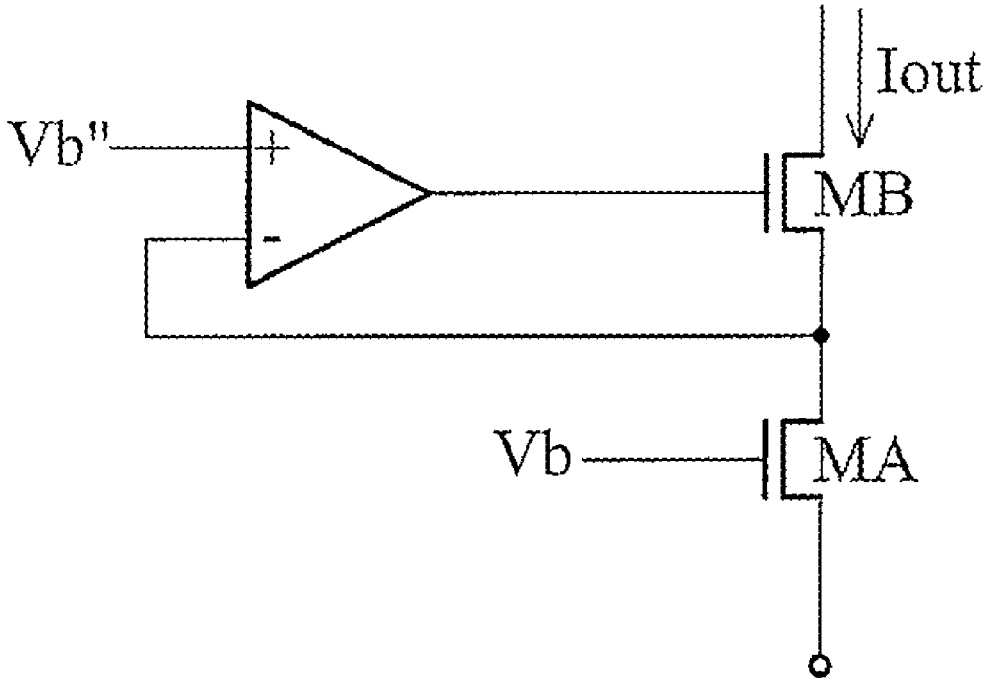
FIG. 3 ( PRIOR ART )
FIG. 3 shows another conventional current source.
Figure 4:
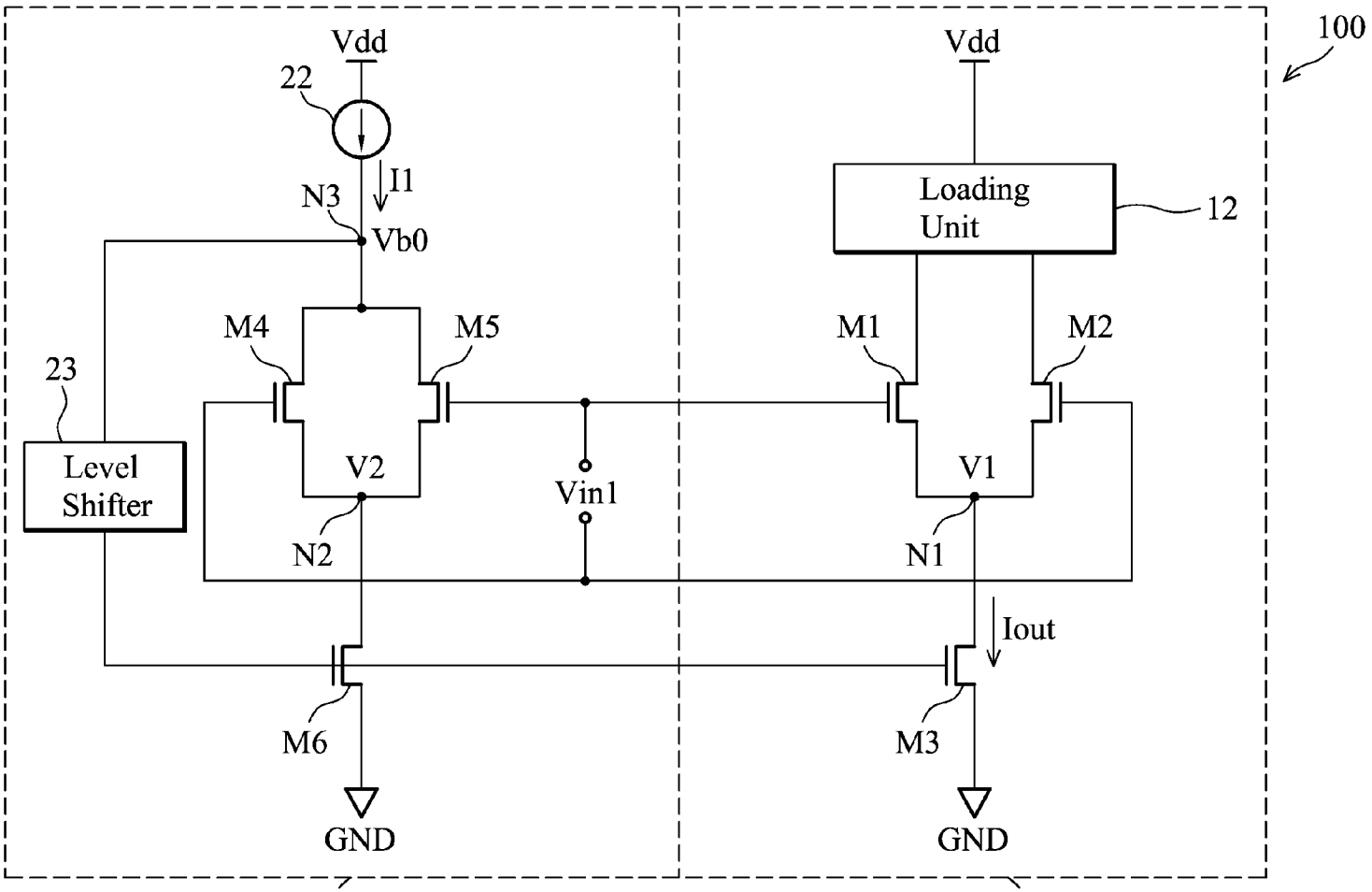
FIG. 4 shows an embodiment of a semiconductor circuit.

FIG. 4 shows an embodiment of a semiconductor circuit. The semiconductor circuit 100 comprises a main circuit 10 and a replica circuit 20. The main circuit 10 can be a differential amplifier to output a differential signal (not shown) according to an input signal Vin1 and comprises MOS transistors M1~M3 and a loading unit 12. The MOS transistor M1 comprises a first terminal coupled to the loading unit 12 and a second terminal coupled to a node N1, and the MOS transistor M2 comprises a first terminal coupled to the loading unit 12 and a second terminal coupled to the node N1. The MOS transistors M1 and M2 are configured as a differential pair and their control terminals receive the input signal Vin1. The MOS transistor M3 comprises a first terminal coupled to the node N1, a second terminal coupled to a first power voltage GND (i.e., ground voltage) and a control terminal. The MOS transistor M3 is configured as a current source to provide a current Iout.

If the replica circuit 20 is removed and the MOS transistor M3 is biased by a constant voltage, a voltage V1 at the node N1 varies with (is changed by) the input signal Vin1, and thus current Iout provided by the MOS transistor M3 (i.e., the current source) cannot be maintained at a constant. For example, as the input signal Vin1 decreases slightly, the voltage V1 at the node N1 decreases accordingly, such that the current Iout provided by the MOS transistor M3 decreases slightly. Alternatively, as the input signal Vin1 increases slightly, the voltage V1 at the node N1 increases accordingly, such that the current Iout provided by the MOS transistor M3 increases slightly.

With the progress of CMOS process, the supply voltage of analog circuits becomes lower and lower, and the PMOS transistor thus have smaller voltage head room. In this embodiment, the replica circuit 20 duplicates the variations in the voltage V1 at the node N1 to dynamically adjust the bias voltage of the MOS transistor M3, such that the current Iout can be maintained at a constant, for example, while an amount of current is induced by a large input signal Vin1 due to the PMOS transistor having small voltage head room. The replica circuit 20 comprises MOS transistors M4~M6 and a constant current source 22. In order to duplicate the variations in the voltage V1 at the node N1 caused by variations in the input signal Vin1 in the main circuit 10, the MOS transistors M4~M6 have the same circuit connection as that of the MOS transistor M1~M3. For example, the MOS transistor M4 comprises a first terminal coupled to a node N2 and a second terminal coupled to a node N3, and the MOS transistor M5 comprises a first terminal coupled to the node N2 and a second terminal coupled to the node N3. The MOS transistors M4 and M5 are configured as a differential pair and their control terminals receive the input signal Vin1. The MOS transistor M6 comprises a first terminal coupled to the node N2, a second terminal coupled to the first power voltage GND (i.e., ground voltage) and a control terminal The MOS transistor M6 is configured as a current source.

The constant current 22 is coupled between a second power voltage Vdd (i.e., power source) and the differential pair comprising the MOS transistors M4 and M5, and the current sources (i.e., MOS transistors M3 and M6) are biased by the bias voltage Vb0 (i.e., the voltage at the node N3).

As the input signal Vin1 decreases slightly, the voltage V1 at the node N1 and the voltage V2 at the node N2 both decrease accordingly. Because the constant current source 22 maintains an output current I1, the bias voltage Vb0 at the node N3 increases such that the current Iout provided by the MOS transistor M3 (i.e., current source) in the main circuit 10 does not decrease due to decrement in the input signal Vin1 (or voltage V1 at the node N1). Alternatively, as the input signal Vin1 increases slightly, the voltage V1 at the node N1 and the voltage V2 at the node N2 both increase accordingly. Because the constant current source 22 maintains its output current I1, the bias voltage Vb0 at the node N3 decreases such that the current Iout provided by the MOS transistor M3 (i.e., current source) in the main circuit 10 does not increase due to increment in the input signal Vin1 (or voltage V1 at the node N1). Hence, the current Iout provided by the MOS transistor M3 in the main circuit 10 can be maintained at a constant regardless of the variation in the input signal Vin1.

In some examples, an optional level shifter 23 can be coupled between the node N3 and the control terminals of the MOS transistors M3 and M6 to level shift the bias voltage Vb0 at the node N3 for biasing the MOS transistors M3 and M6. Moreover, the size of the MOS transistor M3 can be N times that of the MOS transistor M6, in which N>1 but not limited thereto, thus modifying the circuit response.

Figure 5:
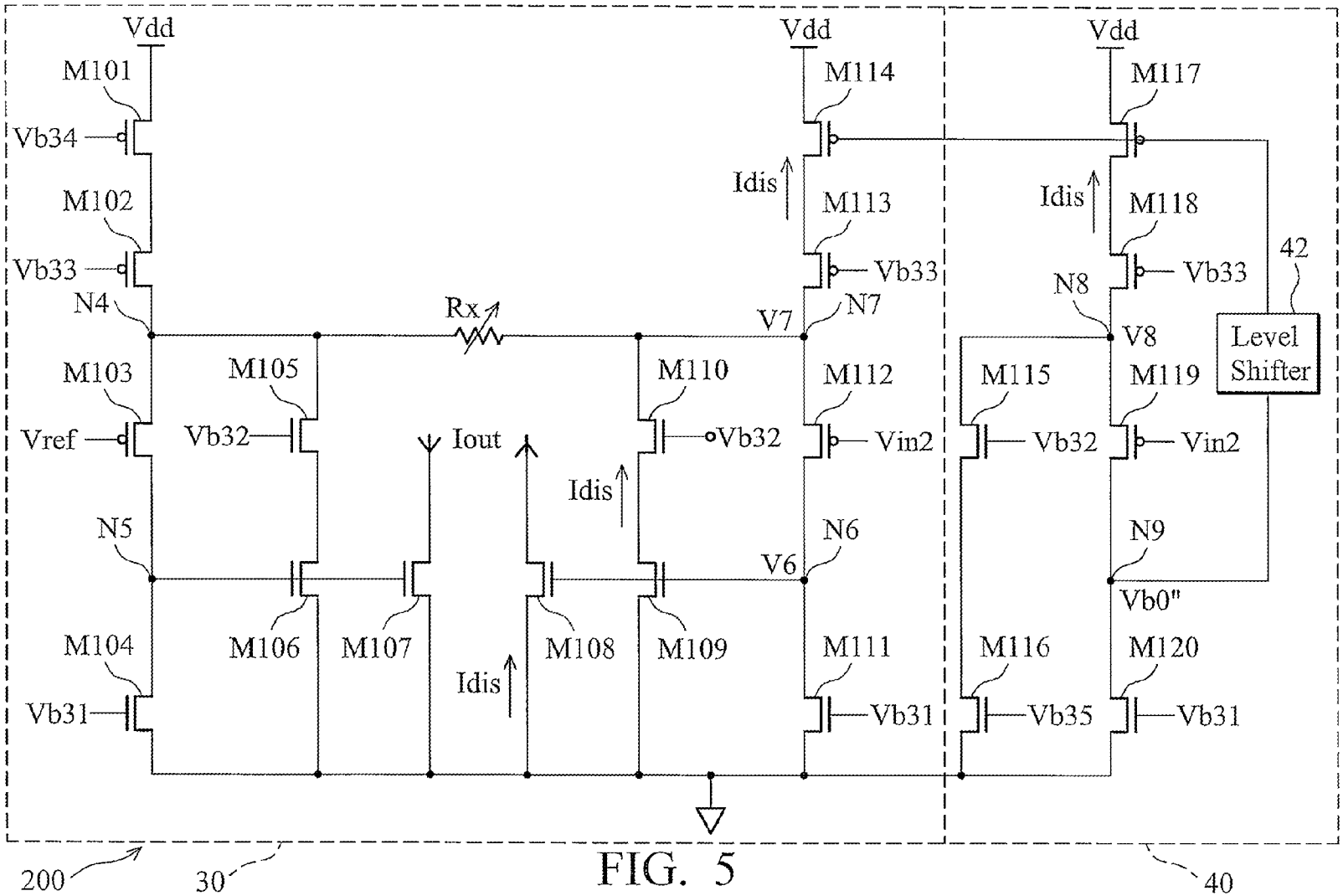
FIG. 5 shows another embodiment of a semiconductor circuit.

FIG. 5 shows another embodiment of a semiconductor circuit. As shown, the semiconductor circuit 200 comprises a main circuit 30 and a replica circuit 40. In this embodiment, the main circuit 30 can be a variable gain amplifier (VGA) based on super-gm circuit and generates differential currents Iout (i.e., Iout+ and Iout−) according to an input signal Vin2, such as an input voltage.

The main circuit 30 comprises MOS transistors M101~M114 and a variable resistor Rx. The MOS transistor M101 comprises a first terminal coupled to the second power voltage Vdd, a second terminal coupled to the MOS transistor M102 and a control terminal coupled to a bias voltage Vb34. The MOS transistor M102 comprises a first terminal coupled to the second terminal of the MOS transistor M101, a second terminal coupled to a node N4, and a control terminal coupled to a bias voltage Vb33. The MOS transistors M101 and M102 are configured as a current source.

The MOS transistor M103 comprises a first terminal coupled to the node N4, a second terminal coupled to a node N5, and a control terminal coupled to a reference voltage Vref (i.e., a constant voltage). The MOS transistor M104 comprises a first terminal coupled to the node N5, a second terminal coupled to the first power voltage GND, and a control terminal coupled to a bias voltage Vb31. The MOS transistor M105 comprises a first terminal coupled to the node N4, a second terminal coupled to the MOS transistor M106 and a control terminal coupled to a bias voltage Vb32. The MOS transistor M106 comprises a first terminal coupled to the second terminal of the MOS transistor M105, a second terminal coupled to the first power voltage GND, and a control terminal coupled to the node N5. The MOS transistor M107 comprises a first terminal providing a current, a second terminal coupled to the first power voltage GND, and a control terminal coupled to the node N5. The variable resistor Rx is coupled between the nodes N4 and N7, and the current Iout (i.e., Iout+ and Iout−) of the main circuit 30 (i.e., the variable gain amplifier) can be adjusted by modifying its resistance. For example, the variable resistor Rx can be configured by a MOS transistor, but is not limited thereto.

The MOS transistor M108 comprises a first terminal providing a current, a second terminal coupled to the first power voltage GND, and a control terminal coupled to the node N6. The MOS transistor M109 comprises a first terminal coupled to the first power voltage GND, a second terminal coupled to the MOS transistor M110, and a control terminal coupled to the node N6. The MOS transistor M110 comprises a first terminal coupled to the node N7, a second terminal coupled to the second terminal of the MOS transistor M109 and a control terminal coupled to the bias voltage Vb32. The MOS transistor M111 comprises a first terminal coupled to the node N6, a second terminal coupled to the first power voltage GND, and a control terminal coupled to the bias voltage Vb31. The MOS transistor M112 comprises a first terminal coupled to the node N7, a second terminal coupled to the node N6, and a control terminal coupled to the input signal Vin2. The MOS transistor M114 comprises a first terminal coupled to the second power voltage Vdd, a second terminal coupled to the MOS transistor M113. The MOS transistor M113 comprises a first terminal coupled to the MOS transistor M114, a second terminal coupled to the node N7, and a control terminal coupled to the bias voltage Vb33.

If the replica circuit 40 is removed and the MOS transistor M114 is biased by the bias voltage Vb34, a voltage V7 at the node N7 varies with (is changed by) the input signal Vin2, and thus current provided by the MOS transistors M113 and 114 (i.e., a current source) cannot be maintained at a constant. The variations in current provided by the MOS transistors M113 and 114 would also occur in the current output from the MOS transistor M108. For example, as the input signal Vin2 increases slightly, the voltage V7 at the node N7 increases and the voltage V6 at the node N6 decreases accordingly, such that the current provided by the MOS transistors M113 and M114 has a current decrement Idis. At this time, the current through the MOS transistor M109 and the current through the MOS transistor M108 both have the same current decrement Idis. Alternatively, as the input signal Vin2 decreases slightly, the voltage V7 at the node N7 decreases and the voltage V6 at the node N6 increases accordingly, such that the current provided by the MOS transistors M113 and M114 has a current increment. At this time, the current through the MOS transistor M109 and the current through the MOS transistor M108 both have the same current increment.

The replica circuit 40 comprises MOS transistors M115~M120, duplicating the variations in the voltage V7 at the node N7 to dynamically adjust the bias voltage of the MOS transistor M114 such that the current through the MOS transistors M113 and M114 can be maintained at a constant.

The MOS transistor M116 comprises a first terminal coupled to the first power voltage GND, a second terminal coupled to the MOS transistor M115, and a control terminal coupled to a bias voltage Vb35. The MOS transistor M115 comprises a first terminal coupled to a node N8, a second terminal coupled to the MOS transistor M116 and a control terminal coupled to the bias voltage Vb32. The MOS transistor M120 comprises a first terminal coupled to a node N9, a second terminal coupled to the first power voltage GND, and a control terminal coupled to the bias voltage Vb31. The MOS transistor M120 can be regarded as a constant current source. The MOS transistor M119 comprises a first terminal coupled to the node N8, a second terminal coupled to the node N9, and a control terminal coupled to the input signal Vin2. The MOS transistor M118 comprises a first terminal coupled to the node N8, a second terminal coupled to the MOS transistor M117, and a control terminal coupled to the bias voltage Vb33. The MOS transistor M117 comprises a first terminal coupled to the second power voltage Vdd, a second terminal coupled to the MOS transistor M118 and a control terminal coupled to the node N9 and the control terminal of the MOS transistor M114.

As the input signal Vin2 increases slightly, the voltage V7 at the node N7 and the voltage V8 at the node N8 both increase accordingly. The voltage at the node N9 (i.e., bias voltage Vb0" of the MOS transistors M114 and M117) decreases when the voltage V8 at the node N8 increases. Meanwhile, the current through the MOS transistor M114 (i.e., the current source) in the main circuit 10 does not decrease due to increment in the input signal Vin2 (or voltage V7 at the node N7). Alternatively, as the input signal Vin2 decreases slightly, the voltage V7 at the node N7 and the voltage V8 at the node N8 both decrease accordingly. The voltage at the node N9 (i.e., bias voltage Vb0" of the MOS transistors M114 and M117) increases when the voltage V8 at the node N8 decreases. Meanwhile, the current through the MOS transistor M114 (i.e., current source) in the main circuit 10 does not increase due to decrement in the input signal Vin2 (or voltage V7 at the node N7). As the current through the MOS transistors M113 and M114 can be maintained at a constant regardless of variations in the input signal Vin2, the current through the MOS transistor M108 can be maintained at a constant.

In some examples, an optional level shifter 42 can be coupled between the node N9 and the control terminals of the MOS transistors M114 and M117 to level shift the bias voltage Vb0" at the node N9 biasing the MOS transistors M114 and M117.

Namely, the embodiments of the invention duplicates a variation in a voltage at the first node caused by a variation in the input signal and dynamically adjust a bias voltage of the first current source according to the duplicated variation such that first current is maintained at a constant.

Figure 6:
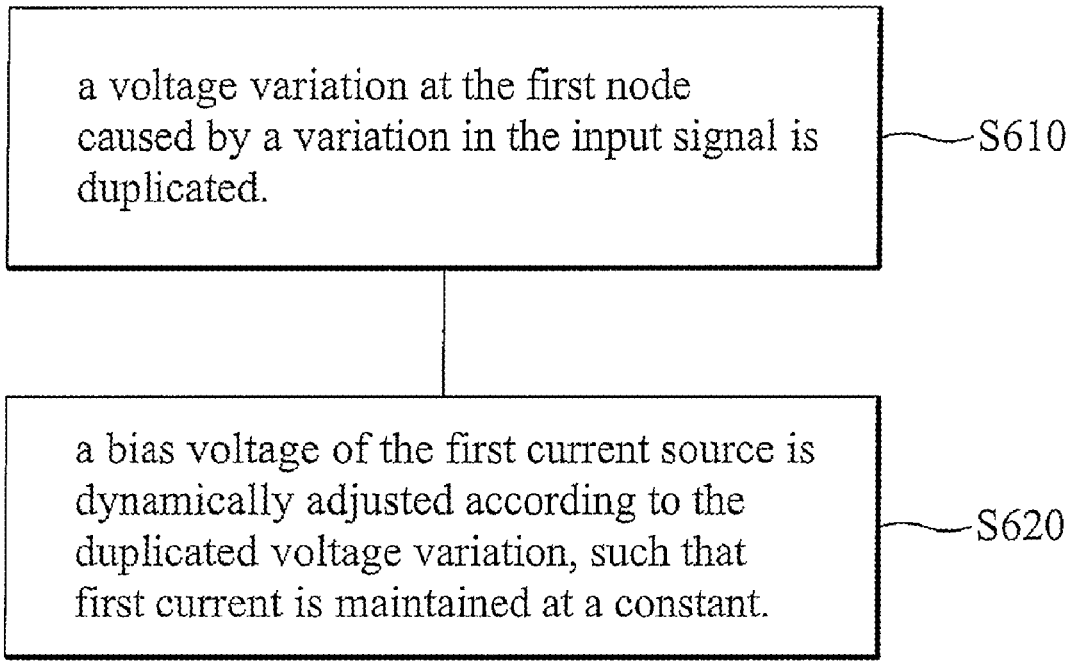
FIG. 6 shown a flowchart of a method for mitigating current variation in a semiconductor circuit.

FIG. 6 shows a flowchart of a method for mitigating current variation in a semiconductor circuit. Detail operations of the method are discussed hereinafter with reference to FIG. 4 and FIG. 5.

In step S610, a voltage variation at the first node caused by a variation in the input signal is duplicated. For example, the replica circuit 20 is provided to duplicate voltage variation at the first node N1 caused by a variation in the input signal Vin1 in the main circuit 10, as shown in FIG. 4. The MOS transistors M4~M6 have the same circuit connection as that of the MOS transistor M1~M3 in order to duplicate the variation in the voltage V1 at the node N1 caused by variations in the input signal Vin1 in the main circuit 10. Namely, the voltage V1 at the node N1 and the voltage V2 at the node N2 both decrease accordingly when the input signal Vin1 decreases slightly, and the voltage V1 at the node N1 and the voltage V2 at the node N2 both increase accordingly when the input signal Vin1 increases slightly. Similarly, the MOS transistors M109~M114 are identical to the MOS transistors M115~M120, as shown in FIG. 5, to duplicate the variations in the voltage V7 at the node N7 caused by variations in the input signal Vin2 in the main circuit 30. Namely, the voltage V7 at the node N7 and the voltage V8 at the node N8 both decrease accordingly when the input signal Vin2 decreases slightly, and the voltage V7 at the node N7 and the voltage V8 at the node N8 both increase accordingly when the input signal Vin2 increases slightly.

In step S620, a bias voltage of the first current source is dynamically adjusted according to the duplicated voltage variation, such that first current is maintained at a constant. For example, as shown in FIG. 4, when the voltage V2 decreases, the bias voltage Vb0 at the node N3 increases, such that the current Iout provided by the MOS transistor M3 in the main circuit 10 does not decrease due to decrement in the input signal Vin1. On the contrary, when the voltage V2 increases, the bias voltage Vb0 at the node N3 decreases, such that the current Iout provided by the MOS transistor M3 in the main circuit 10 does not increase due to increment in the input signal Vin1. Thus, the bias voltage Vb0 of the MOS transistor M3 can be dynamically adjusted according to the duplicated voltage variation, such that current Iout provided by the MOS transistor M3 can be maintained at a constant.

In the embodiment shown in FIG. 5, when the voltage V8 decreases, the voltage Vb0" at the node N9 increases, such that the current through the MOS transistor M114 in the main circuit 30 does not decrease due to decrement in the input signal Vin2. On the contrary, when the voltage V8 increases, the voltage Vb0" at the node N9 decreases, such that the current through the MOS transistor M114 does not increase due to increment in the input signal Vin2. Thus, the bias voltage Vb0" of the MOS transistor M114 is dynamically adjusted according to the duplicated voltage variation, such that the current through the MOS transistor M114 can be maintained at a constant.

Figure 7:
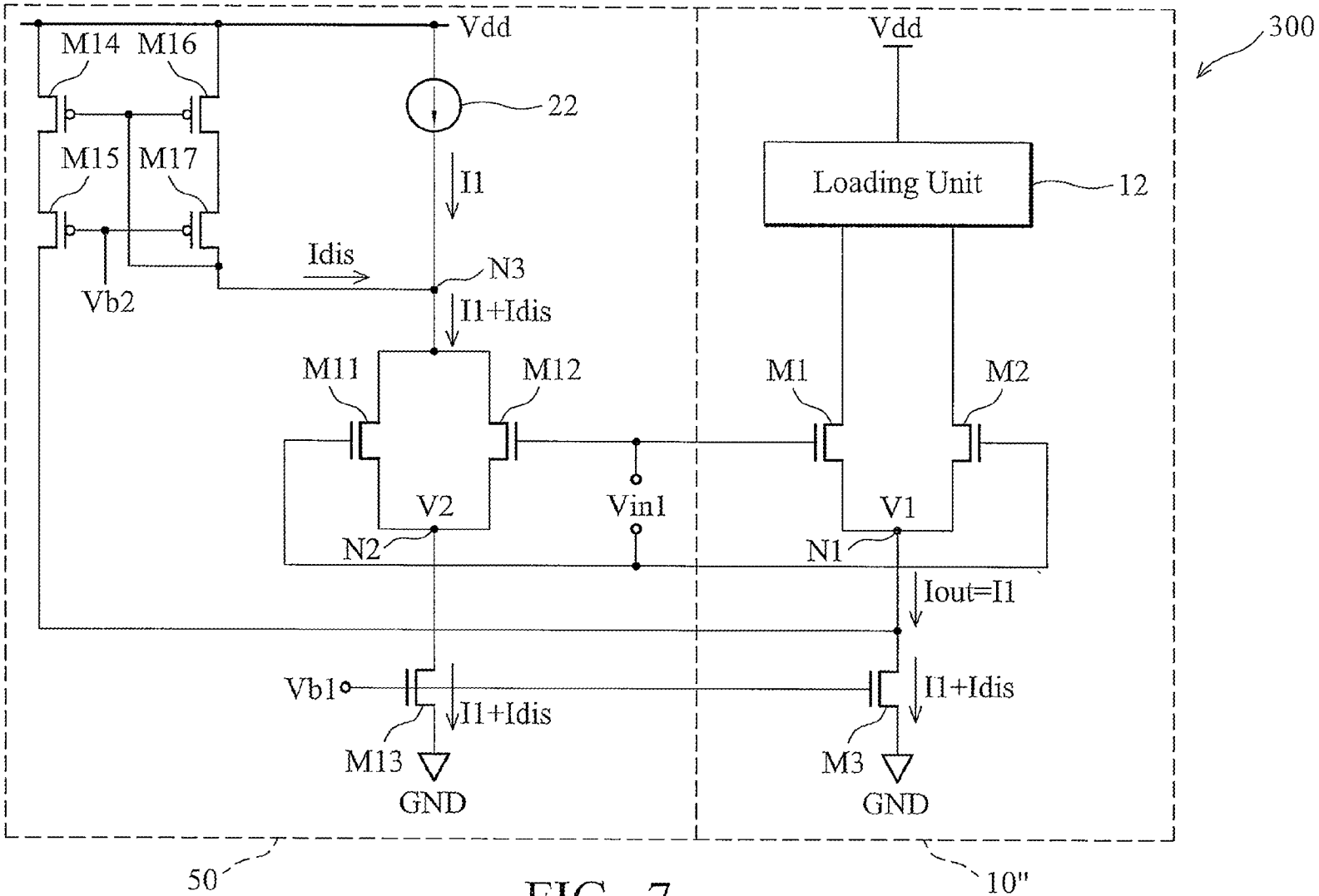
FIG. 7 shows another embodiment of a semiconductor circuit.

FIG. 7 shows another embodiment of a semiconductor circuit. As shown, the semiconductor circuit 300 comprises a main circuit 10" and a replica circuit 50. The main circuit 10" is similar to the main circuit 10 shown in FIG. 4, substantially differing in that the MOS transistor M3 is biased by a constant bias voltage Vb1 and the node N1 is coupled to a replica circuit 50.

Similarly as previous, if the replica circuit 50 is removed, a voltage V1 at the node N1 varies (changes) when there is variations in the input signal Vin1, and thus current provided by the MOS transistor M3 (i.e., the current source) cannot be maintained at a constant. For example, as the input signal Vin1 decreases slightly, the voltage V1 at the node N1 decreases accordingly such that the current provided by the MOS transistor M3 decreases slightly. Alternatively, as the input signal Vin1 increases slightly, the voltage V1 at the node N1 increases accordingly such that the current provided by the MOS transistor M3 increases slightly.

The replica circuit 50 duplicates the current increment or the current decrement in the current through the MOS transistor M3 caused by the variations in the input signal Vin1 and applies the duplicated current increment or the duplicated current decrement to the MOS transistor M3 such that the current through the differential pair (M1 and M2) is maintained at a constant. The replica circuit 50 comprises MOS transistors M11~M17 and a constant current source 22. The constant current source 22 coupled between the second power voltage Vdd and the node N3 is configured to provide a current I1 which is equal to the current Iout through the differential pair (M1 and M2). The MOS transistor M11 comprises a first terminal coupled to the node N3 and a second terminal coupled to a node N2, and the MOS transistor M12 comprises a first terminal coupled to the node N3 and a second terminal coupled to the node N2. The MOS transistors M11 and M12 are configured as a differential pair and their control terminals receive the input signal Vin1. The MOS transistor M13 comprises a first terminal coupled to the node N2, a second terminal coupled to the first power voltage GND (i.e., ground voltage) and a control terminal coupled to the bias voltage Vb1.

The MOS transistor M14 comprises a first terminal coupled to the second power voltage Vdd, a second terminal coupled to the MOS transistor M15, and a control terminal coupled to the node N3. The MOS transistor M15 comprises a first terminal coupled to the MOS transistor M14, a second terminal coupled to the MOS transistor M3, and a control terminal coupled to a bias voltage Vb2. The MOS transistor M16 comprises a first terminal coupled to the second power voltage Vdd, a second terminal coupled to the MOS transistor M17, and a control terminal coupled to the node N3. The MOS transistor M17 comprises a first terminal coupled to the second terminal of the MOS transistor M16, a second terminal coupled to the node N3, and a control terminal coupled to the bias voltage Vb2. The MOS transistors M14~M17 are configured as a current mirror. Namely, the currents through the MOS transistors M17 and M15 are the same.

As the input signal Vin1 increases slightly, the voltage V1 at the node N1 increase accordingly, such that the current through the MOS transistor M3 has a current increment Idis. In this case, the MOS transistors M1~M3 are identical to the MOS transistors M11~M13, and the MOS transistors M3 and M13 provide the same current (i.e., I1+Idis) according to the input signal Vin1. Because the current provided by the current source 22 is maintained at I1, the current increment Idis flowing through the differential pair (M11 and M12) is provided by the MOS transistors M16 and 17. The MOS transistors M14 and M15 also provide the same current increment Idis to the MOS transistor M3 because of current mirror structure. As the current increment Idis through the MOS transistor M3 is provided by the MOS transistors M14 and M15, the current through the differential pair (M1 and M2) can be maintained at Iout (i.e., I1) regardless of the variations in the input signal Vin1.

Alternatively, as the input signal Vin1 decreases slightly, the voltage V1 at the node N1 decreases accordingly, such that the current through the MOS transistor M3 has a current decrement (−Idis). Because the current provided by the current source 22 is maintained at I1, the current decrement (−Idis) through the differential pair (M11 and M12) is provided by the MOS transistors M16 and 17. The MOS transistors M14 and M15 also provide the same current decrement (−Idis) to the MOS transistor M3 because of current mirror structure. As the current decrement (−Idis) through the MOS transistor M3 is provided by the MOS transistors M14 and M15, the current through the differential pair (M1 and M2) can be maintained at Iout (i.e., I1) regardless of the variations in the input signal Vin1.

Figure 8:
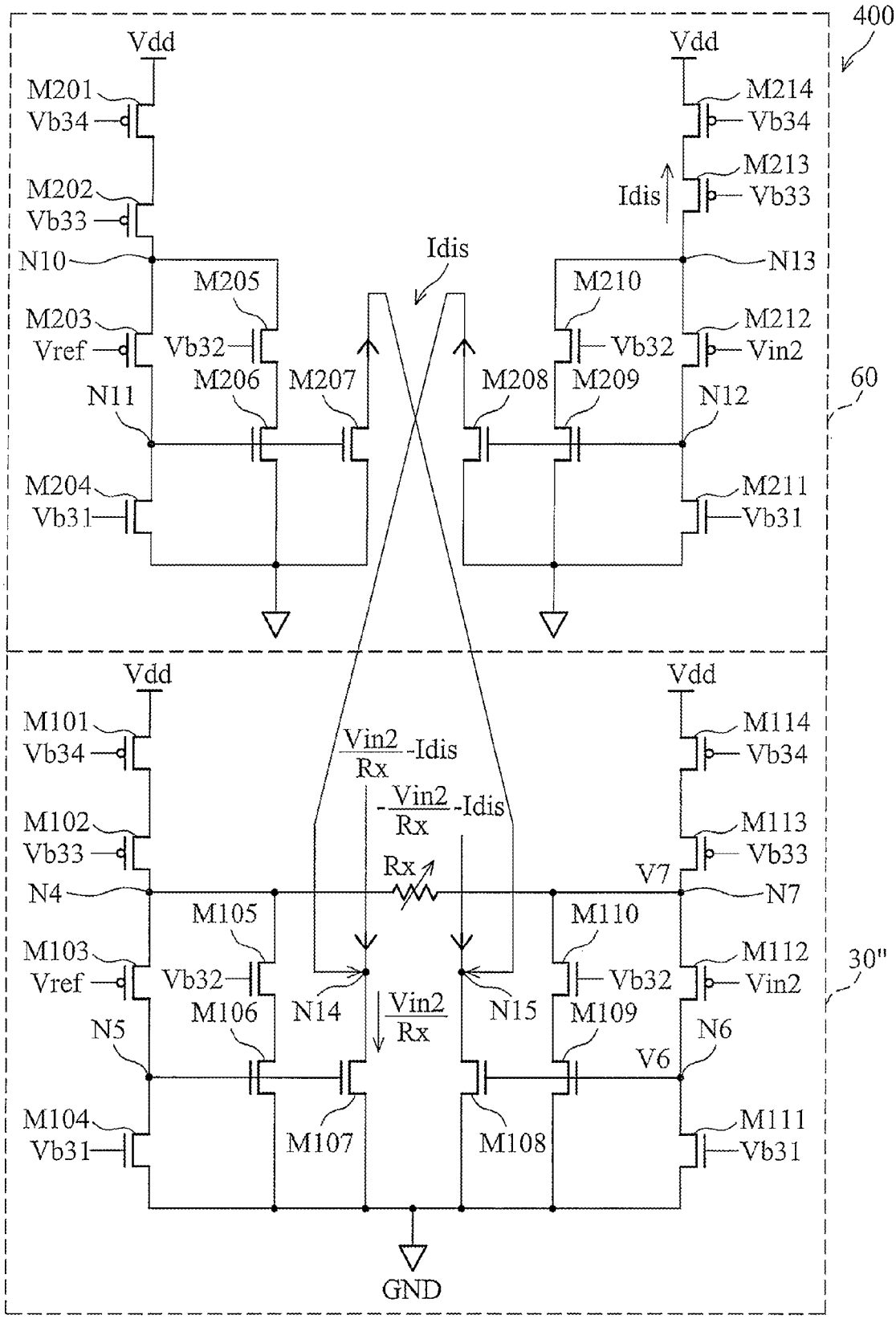
FIG. 8 shows another embodiment of a semiconductor circuit.

FIG. 8 shows another embodiment of a semiconductor circuit. As shown, the semiconductor circuit 400 comprises a main circuit 30" and a replica circuit 60. The main circuit 30" is similar to the main circuit 30 shown in FIG. 5, substantially differing in that the MOS transistor M114 is biased by the bias voltage Vb34 and the MOS transistors M107 and M108 are coupled to the replica circuit 60.

Similarly as previous, if the replica circuit 60 is removed, the voltage V7 at the node N7 varies (changes) when there is variations in the input signal Vin2, thus the current provided by the MOS transistors M113 and 114 (i.e., a current source) cannot be maintained at a constant. The variations in current provided by the MOS transistors M113 and 114 would also occur in the current output from the MOS transistor M108. For example, as the input signal Vin2 increases slightly, the voltage V7 at the node N7 increases and the voltage V6 at the node N6 decreases accordingly, such that the current provided by the MOS transistors M113 and M114 has a current decrement Idis. At this time, the current through the MOS transistor M109 and the current through the MOS transistor M108 both have the same current decrement Idis. Alternatively, as the input signal Vin2 decreases slightly, the voltage V7 at the node N7 decreases and the voltage V6 at the node N6 increases accordingly, such that the current provided by the MOS transistors M113 and M114 has a current increment. At this time, the current through the MOS transistor M109 and the current through the MOS transistor M108 both have the same current increment.

The replica circuit 60 duplicates the current increment or the current decrement in the current through the MOS transistors M113 and M114 caused by the variations in the input signal Vin2 and applies the duplicated current increment or the duplicated current decrement to the main circuit 30" such that the difference between the differential currents provided by the main circuit 30" can be maintained at a constant. As shown, the replica circuit 60 is similar to the main circuit 30", substantially differing in that the variable resistor Rx is omitted. The replica circuit 60 comprises MOS transistors M201~M214.

The MOS transistor M201 comprises a first terminal coupled to the second power voltage Vdd, a second terminal coupled to the MOS transistor M202 and a control terminal coupled to the bias voltage Vb34. The MOS transistor M202 comprises a first terminal coupled to the MOS transistor M201, a second terminal coupled to a node N10, and a control terminal coupled to the bias voltage Vb33. The MOS transistors M201 and M202 are configured as a current source.

The MOS transistor M203 comprises a first terminal coupled to the node N10, a second terminal coupled to a node N11, and a control terminal coupled to the reference voltage Vref. The MOS transistor M204 comprises a first terminal coupled to the node N11, a second terminal coupled to the first power voltage GND, and a control terminal coupled to the bias voltage Vb31. The MOS transistor M205 comprises a first terminal coupled to the node N10, a second terminal coupled to the MOS transistor M206 and a control terminal coupled to the bias voltage Vb32. The MOS transistor M206 comprises a first terminal coupled to the MOS transistor M205, a second terminal coupled to the first power voltage GND, and a control terminal coupled to the node N11. The MOS transistor M207 comprises a first terminal coupled to the node N15 in the main circuit 30", a second terminal coupled to the first power voltage GND, and a control terminal coupled to the node N11. The MOS transistors M201~M207 are identical to the MOS transistors M101~M107 to duplicate the current variation in the current through the MOS transistors M101 and M102 caused by the variation in the voltage Vref. As the voltage Vref is a constant voltage with almost no variation rather than an input signal, there is no variation in voltages at nodes N4 and N5. Hence, the current through the MOS transistors M101 and M102 has no current variation and thus there is no current (distortion current) through the MOS transistor M207.

The MOS transistor M208 comprises a first terminal coupled to the node N14 in the main circuit 30", a second terminal coupled to the first power voltage GND, and a control terminal coupled to a node N12. The MOS transistor M209 comprises a first terminal coupled to the first power voltage GND, a second terminal coupled to the MOS transistor M210, and a control terminal coupled to the node N12. The MOS transistor M210 comprises a first terminal coupled to a node N13, a second terminal coupled to the MOS transistor M209 and a control terminal coupled to the bias voltage Vb32. The MOS transistor M211 comprises a first terminal coupled to the node N12, a second terminal coupled to the first power voltage GND, and a control terminal coupled to the bias voltage Vb31. The MOS transistor M212 comprises a first terminal coupled to the node N13, a second terminal coupled to the node N12, and a control terminal coupled to the input signal Vin2. The MOS transistor M214 comprises a first terminal coupled to the second power voltage Vdd, a second terminal coupled to the MOS transistor M213 and a control terminal coupled to the bias voltage Vb34. The MOS transistor M213 comprises a first terminal coupled to the MOS transistor M214, a second terminal coupled to the node N13, and a control terminal coupled to the bias voltage Vb33.

As the input signal Vin2 increases slightly, the voltage V7 at the node N7 increases and the voltage V6 at the node N6 decreases accordingly, such that the current through the MOS transistors M113 and M114 has a current decrement (distortion current) Idis. At this time, the current through the MOS transistor M109 and the current through the MOS transistor M108 both have the same current decrement Idis. In this case, the MOS transistors M209~M214 are identical to the MOS transistors M109~M114, and the MOS transistors M113 and M213 have the same current decrement (Idis) according to the input signal Vin2. Because the variable resistor Rx in omitted in replica circuit 60, the MOS transistors M209 and M210 only flow through the current decrement (Idis) as well as the MOS transistor M208. Namely, the MOS transistors M208~M214 duplicate the current decrement Idis caused by the voltage increment in the input signal Vin2 in main circuit 30". In this case, the voltage Vref is constant voltage, there is no current variation in current through the MOS transistor M107 caused by the voltage Vref and thus, the MOS transistor M207 outputs no current. As the current decrement Idis duplicated by the replica circuit 60 is feedback to the node N14 in the main circuit 30", the currents input to the main circuit 30" can be $$\frac{Vin2}{Rx} - Idis \text{ and } -\frac{Vin2}{Rx} - Idis$$

respectively. Hence, the difference between the two currents $$\frac{Vin2}{Rx} - Idis \text{ and } -\frac{Vin2}{Rx} - Idis$$

can be maintained at a constant regardless of the increments in the input signal Vin2.

Alternatively, as the input signal Vin2 decreases slightly, the voltage V7 at the node N7 decreases and the voltage V6 at the node N6 increases accordingly, such that the current through the MOS transistors M113 and M114 has a current increment (distortion current). At this time, the current through the MOS transistor M109 and the current through the MOS transistor M108 both have the same current increment. In this case, the MOS transistors M209~M214 are identical to the MOS transistors M109~M114, and the MOS transistors M113 and M213 have the same current increment according to the input signal Vin2. Because the variable resistor Rx in omitted in replica circuit 60, the MOS transistors M209 and M210 only flow through the current increment as well as the MOS transistor M208. Namely, the MOS transistors M208~M214 duplicate the current increment caused by the voltage decrement in the input signal Vin2 in main circuit 30". As the voltage Vref is constant voltage, there is no current variation in current through the MOS transistor M107 caused by the voltage Vref and thus, the MOS transistor M207 outputs no current. The current increment duplicated by the replica circuit 60 is feedback to the node N14 in the main circuit 30", such that the difference between the currents input to the main circuit 30" can be maintained at a constant regardless of the decrements in the input signal Vin2.

Namely, the embodiments of the invention duplicate a distortion current through the first current source caused by a variation in the input signal and then output it to the main circuit such that an output current of the main circuit can be maintained at a constant.

Figure 9:
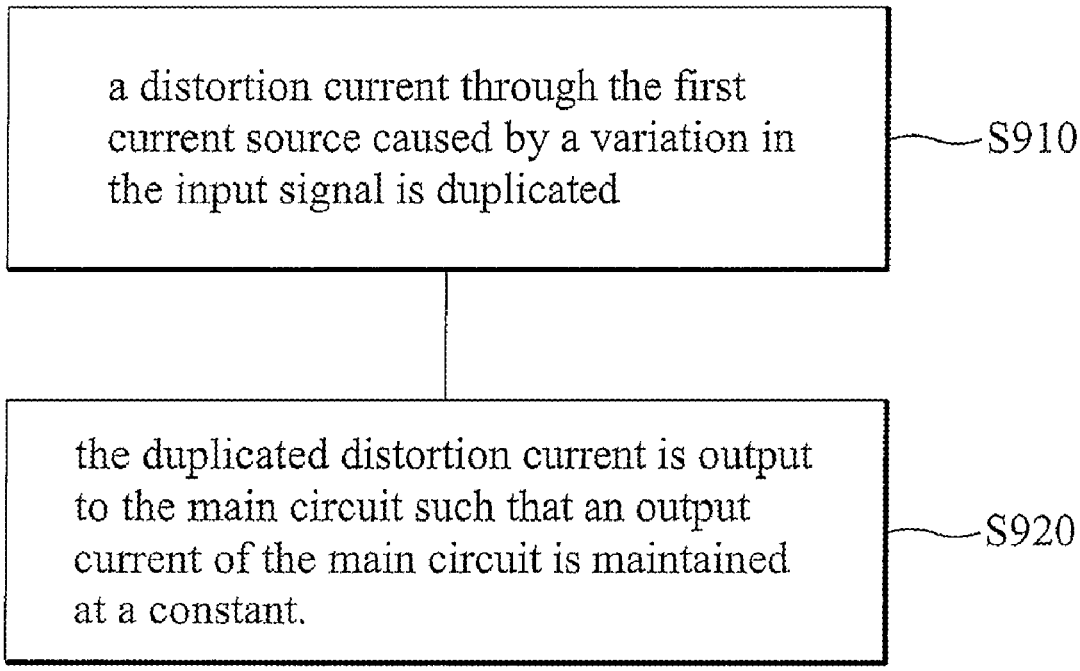
FIG. 9 shows another flowchart of a method for mitigating current variation in a semiconductor circuit.

FIG. 9 shows another flowchart of a method for mitigating current variation in a semiconductor circuit. Detail operations of the method are discussed hereinafter with reference to FIG. 7 and FIG. 8. In step S910, a distortion current through the first current source caused by a variation in the input signal is duplicated. For example, the replica circuit 50 is provided to duplicate the current increment or the current decrement in the current through the MOS transistor M3 caused by a variation in the input signal Vin1 in the main circuit 10", as shown in FIG. 7. As the input signal Vin1 increases slightly, the voltage V1 at the node N1 increase accordingly, such that the current through the MOS transistor M3 has a current increment Idis. Because the MOS transistors M11~M13 are identical to the MOS transistors M1~M3, and the MOS transistors M3 and M13 provide the same current (i.e., I1+Idis) according to the input signal Vin1. Because the current provided by the current source 22 is maintained at I1, the current increment Idis flowing through the differential pair (M11 and M12) is provided by the MOS transistors M16 and 17. The MOS transistors M14 and M15 also provide the same current increment Idis to the MOS transistor M3 because of current mirror structure. Thus, the current increment Idis to the MOS transistor M3 is obtained.

Alternatively, as the input signal Vin1 decreases slightly, the voltage V1 at the node N1 decreases accordingly, such that the current through the MOS transistor M3 has a current decrement (−Idis). Because the current provided by the current source 22 is maintained at I1, the current decrement (−Idis) through the differential pair (M11 and M12) is provided by the MOS transistors M16 and 17. The MOS transistors M14 and M15 also provide the same current decrement (−Idis) to the MOS transistor M3 because of current mirror structure. Thus, the current decrement (−Idis) to the MOS transistor M3 is obtained.

In the embodiment shown in FIG. 9, when the input signal Vin2 increases slightly, the voltage V7 at the node N7 increases and the voltage V6 at the node N6 decreases accordingly, such that the current through the MOS transistors M113 and M114 has a current decrement (distortion current) Idis. At this time, the current through the MOS transistor M109 and the current through the MOS transistor M108 both have the same current decrement Idis. Hence, the MOS transistors M209~M214 are identical to the MOS transistors M109~M114, and the MOS transistors M113 and M213 have the same current decrement (Idis) according to the input signal Vin2. On the contrary, when the input signal Vin2 decreases slightly, the voltage V7 at the node N7 decreases and the voltage V6 at the node N6 increases accordingly, such that the current through the MOS transistors M113 and M114 has a current increment (distortion current). At this time, the current through the MOS transistor M109 and the current through the MOS transistor M108 both have the same current increment. In this case, the MOS transistors M209~M214 are identical to the MOS transistors M109~M114, and the MOS transistors M113 and M213 have the same current increment according to the input signal Vin2.

In step S920, the duplicated distortion current is output to the main circuit such that an output current of the main circuit is maintained at a constant. As shown in FIG. 7, the MOS transistor M15 outputs the current increment Idis to the MOS transistor M3 when the input signal Vin1 increases, and thus, the current through the differential pair (M1 and M2) can be maintained at Iout (i.e., I1) regardless of the increment in the input signal Vin1. On the contrary, the MOS transistor M15 outputs the current decrement (−Idis) to the MOS transistor M3 when the input signal Vin1 decreases, and thus, the current through the differential pair (M1 and M2) can be maintained at Iout (i.e., I1) regardless of the decrement in the input signal Vin1.

In the embodiment shown in FIG. 9, the current decrement Idis duplicated by the replica circuit 60 is feedback to the node N14 in the main circuit 30" when the input signal Vin2 increases slightly, such that the currents input to the main circuit 30" can be $$\frac{Vin2}{Rx} - Idis \text{ and } -\frac{Vin2}{Rx} - Idis$$

respectively. Hence, the difference between the two currents $$\frac{Vin2}{Rx} - Idis \text{ and } -\frac{Vin2}{Rx} - Idis$$

can be maintained at a constant regardless of the increments in the input signal Vin2. Alternatively, the current increment duplicated by the replica circuit 60 is feedback to the node N14 in the main circuit 30" when the input signal Vin2 decreases slightly, such that the difference between the currents input to the main circuit 30" can be maintained at a constant regardless of the decrements in the input signal Vin2.

While the invention has been described by way of example and in terms of preferred embodiment, it is to be understood that the invention is not limited thereto. To the contrary, it is intended to cover various modifications and similar arrangements (as would be apparent to those skilled in the Art). Therefore, the scope of the appended claims should be accorded the broadest interpretation so as to encompass all such modifications and similar arrangements.

What is claimed is:

1. A semiconductor circuit, comprising:

a main circuit receiving an input signal and comprising:

a first current source coupled between a first node and a first power voltage to generate a first current according to a first bias voltage; and a replica circuit coupled to the main circuit to duplicate a variation in a voltage at the first node caused by a variation in the input signal and dynamically adjust the first bias voltage according to the duplicated variation such that the first current is maintained at a constant, wherein the replica circuit comprises:

a second current source coupled between a second power voltage and a second node;

a differential pair coupled between the second node and a third node, receiving the input signal;

a third current source coupled between the third node and the first power voltage, wherein bias control terminals of the first and third current sources are coupled to the second node; and a level shifter coupled between the second node and the bias control terminals of the first and the third current sources.

2. The semiconductor circuit as claimed in claim 1, wherein the main circuit comprises:

a first transistor coupled between the first node and the first power voltage and comprising a control terminal coupled to the first bias voltage to serves as the first current source; and a differential amplifier comprising:

a loading unit;

a second transistor comprising a first terminal coupled to the loading unit, a second terminal coupled to the first current source, and a control terminal; and a third transistor comprising a first terminal coupled to the loading unit, a second terminal coupled to the first current source, and a control terminal, wherein the control terminals of the first and second transistors for receiving the input signal.

3. The semiconductor circuit as claimed in claim 1, wherein the main circuit comprises:

a first differential pair coupled between a loading unit and the first node, receiving the input signal; and the first current source coupled between the first node and the first power voltage.

4. The semiconductor circuit as claimed in claim 1, wherein the second current source is a constant current source.

5. The semiconductor circuit as claimed in claim 1, wherein the first bias voltage is a voltage at the second node.

6. The semiconductor circuit as claimed in claim 1, wherein the main circuit comprises a variable gain amplifier comprising:

a second current source coupled between a second node and a second power voltage;

a first transistor coupled between the second node and a third node and comprising a control terminal coupled to a reference voltage;

a second transistor coupled between the third node and the first power voltage;

a third transistor comprising a first terminal coupled to the second node, and a second terminal;

a fourth transistor coupled between the second terminal of the third transistor and the first power voltage and comprising a control terminal coupled to the third node;

a fifth transistor comprising a first terminal coupled to the first power voltage, a control terminal coupled to the third node, and a second terminal;

sixth and seventh transistors coupled in series between the second power voltage and a fourth node to serve as the first current source, wherein the sixth transistor comprises a control terminal coupled to the first bias voltage;

a resistor coupled between the second node and the fourth node;

an eighth transistor coupled between the fourth node and a fifth node, and comprising a control terminal coupled to the input signal;

a ninth transistor coupled between the fifth node and the first power voltage;

a tenth transistor comprising a first terminal coupled to the fourth node, and a second terminal;

an eleventh transistor coupled between the second terminal of the tenth transistor and the first power voltage, and comprising a control terminal coupled to the fifth node; and a twelfth transistor comprising a first terminal coupled to the first power voltage, a control terminal coupled to the fifth node, and a second terminal, wherein the second terminals of the fifth and twelfth transistors for outputting differential currents.

7. A method for mitigating current variation in a semiconductor circuit, in which the semiconductor circuit comprises a main circuit receiving an input signal and comprising a first current source coupled between a first node and a first power voltage, the method comprising:

duplicating, by a replica circuit, a voltage variation at the first node caused by a variation in the input signal;

adjusting, by a level shifter, a bias voltage of the replica circuit, the level shifter being coupled to the main circuit; and dynamically adjusting a bias voltage of the first current source according to the duplicated voltage variation such that a first current provided by the first current source is maintained at a constant.

8. The method as claimed in claim 7, wherein the bias voltage of the first current source is increased when a voltage at the first node decreases, and the bias voltage of the first current source is decreased when a voltage at the first node increases, such that the first current is maintained at a constant.

9. A semiconductor circuit, comprising:

a main circuit receiving an input signal and comprising:

a first current source coupled between a first node and a power voltage to generate a first current according to a first bias voltage; and a loading unit coupled to a second power voltage; and a replica circuit coupled to the main circuit to duplicate a variation in a voltage at the first node caused by a variation in the input signal and dynamically adjust the first bias voltage according to the duplicated variation such that the first current is maintained at a constant, wherein the replica circuit comprises:

a second current source coupled between a second power voltage and a second node;

a differential pair coupled between the second node and a third node, receiving the input signal;

a third current source coupled between the third node and the first power voltage; and a level shifter coupled between the second node and bias control terminals of the first and the third current sources.

* * * * *